US008534581B2

(12) United States Patent
Cooper et al.

(10) Patent No.: US 8,534,581 B2
(45) Date of Patent: Sep. 17, 2013

(54) RECEPTACLE FOR COILED WIRE

(75) Inventors: William D. Cooper, Chardon, OH (US); Paul A. Weissbrod, South Euclid, OH (US); Yonatan Necoechea, Richmond Heights, OH (US)

(73) Assignee: Lincoln Global, Inc., City of Industry, CA (US)

( * ) Notice: Subject to any disclaimer, the term of this patent is extended or adjusted under 35 U.S.C. 154(b) by 264 days.

(21) Appl. No.: 12/466,897

(22) Filed: May 15, 2009

(65) Prior Publication Data

US 2010/0282630 A1 Nov. 11, 2010

Related U.S. Application Data

(60) Provisional application No. 61/177,023, filed on May 11, 2009.

(51) Int. Cl.
*B65H 55/00* (2006.01)

(52) U.S. Cl.
USPC ..... 242/172; 206/397

(58) Field of Classification Search
USPC ..... 242/423, 423.1, 159, 172, 160.3; 206/386, 389, 395, 396, 397, 398, 406–409
See application file for complete search history.

(56) References Cited

U.S. PATENT DOCUMENTS

| | | | | |
|---|---|---|---|---|
| 874,160 | A * | 12/1907 | Buckborough | 206/416 |
| 2,625,317 | A * | 1/1953 | MacChesney | 206/416 |
| 5,105,943 | A | 4/1992 | Lesko et al. | |
| 5,819,934 | A * | 10/1998 | Cooper | 206/397 |
| 6,237,768 | B1 * | 5/2001 | Cipriani | 206/408 |
| 6,481,575 | B2 * | 11/2002 | Cipriani | 206/408 |
| 6,715,608 | B1 * | 4/2004 | Moore | 206/397 |
| 6,827,217 | B2 | 12/2004 | Matsuguchi et al. | |
| 6,857,521 | B2 * | 2/2005 | Cantu-Gonzalez | 206/397 |
| 7,172,070 | B2 * | 2/2007 | Coon et al. | 206/397 |
| 7,222,734 | B2 * | 5/2007 | Barton | 206/389 |
| 7,331,457 | B2 * | 2/2008 | Cipriani | 206/408 |

FOREIGN PATENT DOCUMENTS

| | | | |
|---|---|---|---|
| DE | 3221933 | A1 | 12/1983 |
| DE | 202004000906 | U1 | 4/2004 |

* cited by examiner

*Primary Examiner* — William A Rivera
(74) *Attorney, Agent, or Firm* — Hahn, Loeser & Parks, LLP

(57) ABSTRACT

The present invention pertains to a hold down device for coiled wire stored in a wire storing container having a heading member that bounds a first coil face, a cover member bounding a second coil face, and a tensioning device extendable between the heading member and the cover member where the tensioning device is capable of applying compressive force between the heading member and the cover member. The heading member is fashioned having an integrally formed handle that eliminates the need to incorporate additional components for connecting to the tensioning device.

15 Claims, 5 Drawing Sheets

RECEPTACLE FOR COILED WIRE

This utility patent application claims priority to U.S. provisional patent application Ser. No. 61/177,023 filed on May 11, 2009, which is incorporated herein by reference in its entirety.

TECHNICAL FIELD

The present invention pertains to packaging coiled wire, and more particularly, hold down systems used in packaging coiled wire.

BACKGROUND OF THE INVENTION

Wire is frequently wound in continuous lengths and stored within a container or cylindrical drum for shipping or storage purposes. One manner of packaging wire, which is economically desirable, involves the use of a paperboard or cardboard container having a bottom heading and an inner core extending upward from the bottom heading around which the wire may be coiled. In packing the drum, wire is typically drawn from a machine and fed in a continuous process into the container. The wire doesn't actually wind on the core but falls loosely between the core and side walls, and onto the bottom heading. During pay out, the wire emerges having a twist, adding to the difficulty of handling the wire as well as potentially affecting the process using the wire. To compensate, the wire may be pre-twisted prior to being fed into the container, which results in residual spring forces stored within the coil. To keep loops of wire from lifting off of the coil, hold down devices are used to cap the top and/or bottom of the coil.

BRIEF SUMMARY

The embodiments of the present invention pertain to a hold down device for coiled wire stored in a wire storing container having a heading member that bounds a first coil face, a cover member bounding a second coil face, and a tensioning device extendable between the heading member and the cover member where the tensioning device is capable of applying compressive force between the heading member and the cover member. The heading member is fashioned having an integrally formed handle that eliminates the need to incorporate additional components for connecting to the tensioning device.

DETAILED DESCRIPTION OF THE INVENTION

Figure 1:
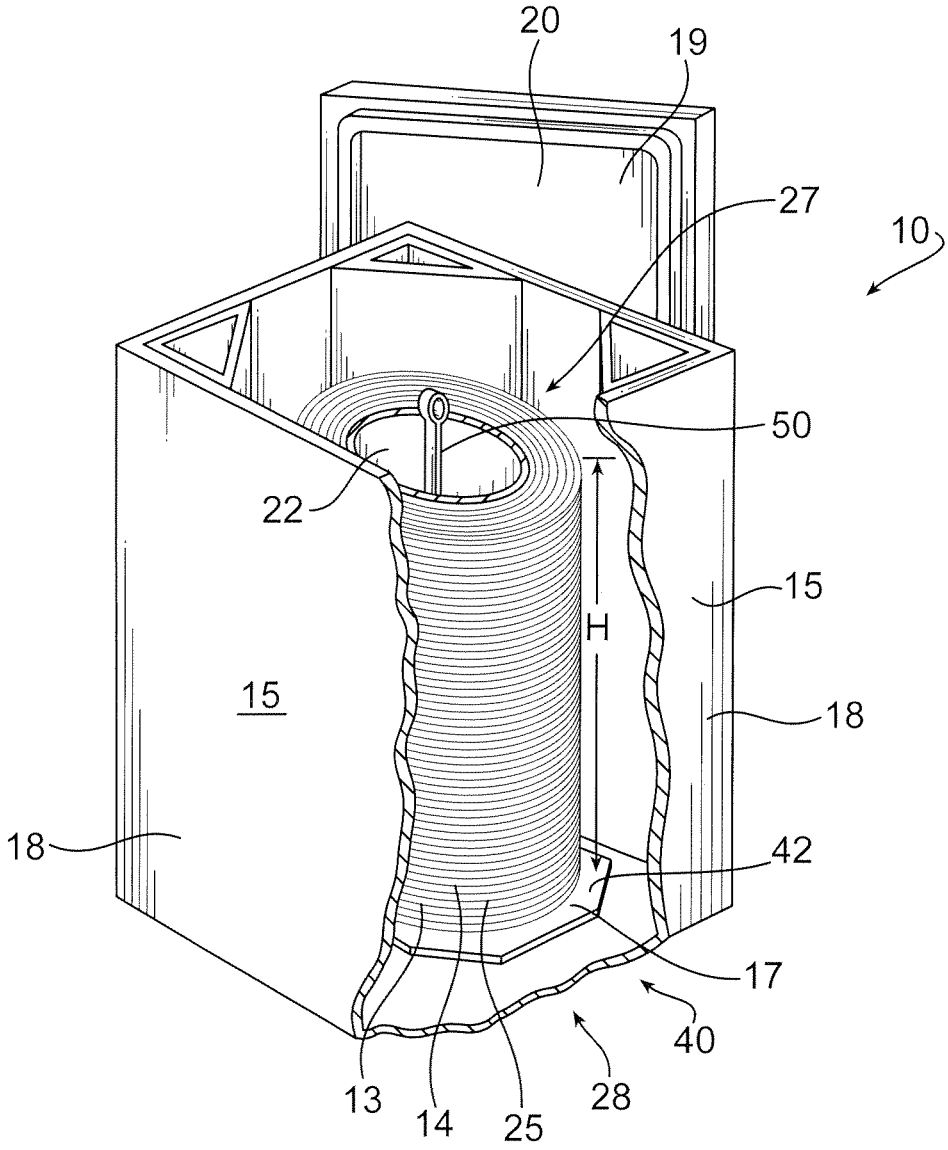
FIG. 1 is a perspective view of a receptacle for storing wire according to the embodiments of the subject invention.

Referring now to the drawings wherein the showings are for purposes of illustrating embodiments of the invention only and not for purposes of limiting the same, FIG. 1 shows a receptacle, depicted generally at 10, for packaging wire 13. The receptacle 10 includes multiple walls 15 that define an internal region used to contain wire 13 for storage, shipping, or other purposes. The receptacle 10, also referred to herein as container 10, may be box-like in configuration including a bottom wall or wall portion 17, side wall portions 18 and a top wall portion 19. However, other configurations of receptacles 10 including but not limited to cylindrical drums may be utilized without departing from the intended scope of coverage of the embodiments of the subject invention. In one embodiment, the top wall portion 19 may comprise an openable or removable lid 20. In this manner, the receptacle 10 may be closed or sealed to prevent elements and/or ambient conditions from affecting wire 13 inside. Wire 13 may be stored in the receptacle 10 in a coiled fashion, wherein individual loops of wire 13 are layered around a core 22 in succession and stacked through the height of the receptacle 10. In this manner, a large quantity of wire 13 may be stored in bulk within the receptacle 10 as a singular, continuously formed length of wire 13.

The receptacle 10 may be constructed from fibrous material. In particular, the receptacle 10 may be fashioned from cardboard, paperboard, or any material of suitable strength sturdy enough to contain wire 13 as described herein. Additionally, the material making up the receptacle walls may be recyclable allowing the receptacle 10 to be constructed, and subsequently reused, in an economical manner. It is noted that cardboard typically includes corrugated layers. However, it is to be construed that materials making up the receptacle 10 or receptacle walls 15 may be constructed from layers of materials that are not undulated.

In one embodiment, wire 13 may be welding wire 14. Welding wire 14 is frequently stored in relatively long, continuous lengths for supplying a welding machine, not shown, in a continuous feed process. Due to its coiled nature, welding wire 14 may rotate during pay out, which may be detrimental to the welding process as well as making it difficult for the end user to handle. To counter the effects, suppliers typically incorporate a twist in the wire 14 as it is fed into the receptacle 10, which helps the wire 14 emerge without rotating as it is drawn back out. Resultantly, welding wire 14 includes residual spring forces that act to lift layers of wire 14 off the coiled stack 25, referred to herein as coil 25. A hold down system 40 is therefore included with the receptacle 10 to prevent welding wire 14 from unraveling, or loops of welding wire 14 from lifting off of the coil 25 as will be discussed below.

Figure 2:
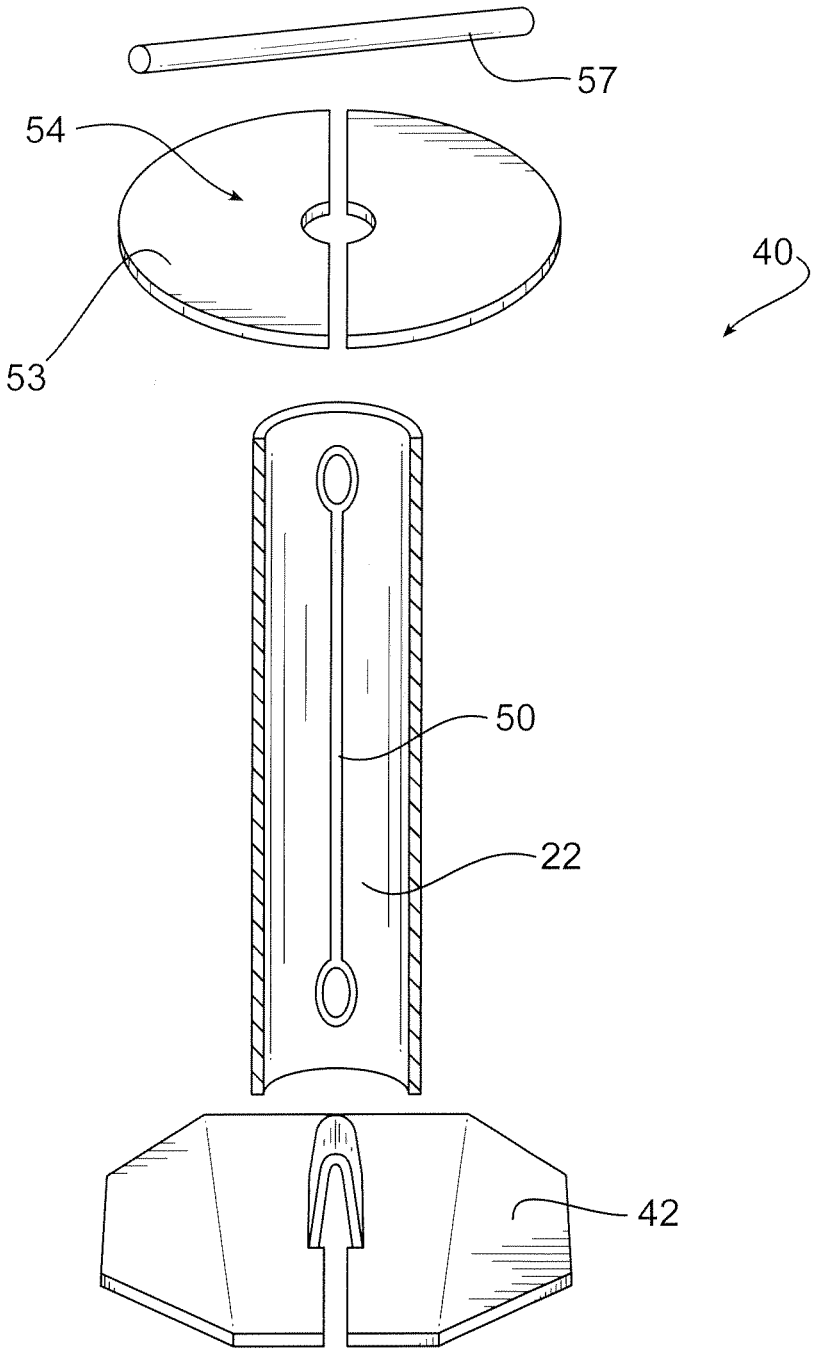
FIG. 2 is a partial cutaway perspective view of a hold down system for storing wire in a receptacle according to the embodiments of the subject invention.

Referencing FIGS. 1 and 2, the hold down system 40 functions to prevent wire 13, 14 from unraveling within the receptacle 10 until paid out for use in a particular operation. At such a time, the hold down system 40 may be removed or disassembled and the wire 13, 14 fed into the application for which it is intended, which in one embodiment may be a wire feeder, also not shown. It will be readily seen that the coil 25 defines distal ends or faces, which may be referenced as the upper 27 and lower 28 face. For discussion purposes, the upper face 27 may reside next to the lid 20 of the receptacle 10 and the bottom face 28 distally positioned next to the bottom wall portion 17. For receptacles 10 having symmetrical or indistinguishable end configurations, the coil faces may simply be referred to as first 27 and second 28 faces.

The hold down system 40 may include a heading member 42, which may be utilized to cap at least one of the faces 27, 28 of the coil 25. The heading member 42 may be fashioned as a generally planar article spanning an area corresponding to the face 27, 28 of the coil 25. By spanning an area corresponding to the face 27, 28 of the coil 25, it is meant that the surface area of the heading member 42 is substantially the same as the area of the coil face 27, 28 or is somewhat larger than the area of the coil face 27, 28. Stated another way, the circumference of the heading member 42 may be substantially the same as or somewhat larger than the circumference of the face(s) 27, 28 of the coil 25. It is noteworthy to mention here that additional embodiments are contemplated wherein the area and/or circumference of the heading member 42 may be less than that of the coil face 27, 28. Still, the heading member 42 may have any dimensional characteristics, as well as any shape or configuration, appropriate for use with the embodiments of the subject invention.

The outer shape of the heading member 42 may correspond to the cross sectional shape of the receptacle 10. Accordingly, the outer shape may refer to the footprint of the heading member 42 when placed within the receptacle 10. Given a cylindrical drum, the heading member 42, for example, may be generally circular in shape. For receptacles 10 having a polygonal shape, the heading member 42 may similarly match the internal configuration of the receptacle 10. Of course, it follows that the circumference of the heading member 42 will be dimensionally smaller than the cross section of the receptacle 10. Still, it is to be construed that any shape of heading member 42, similar or disparate with respect to the receptacle 10, may be chosen with sound judgment.

Figure 3:
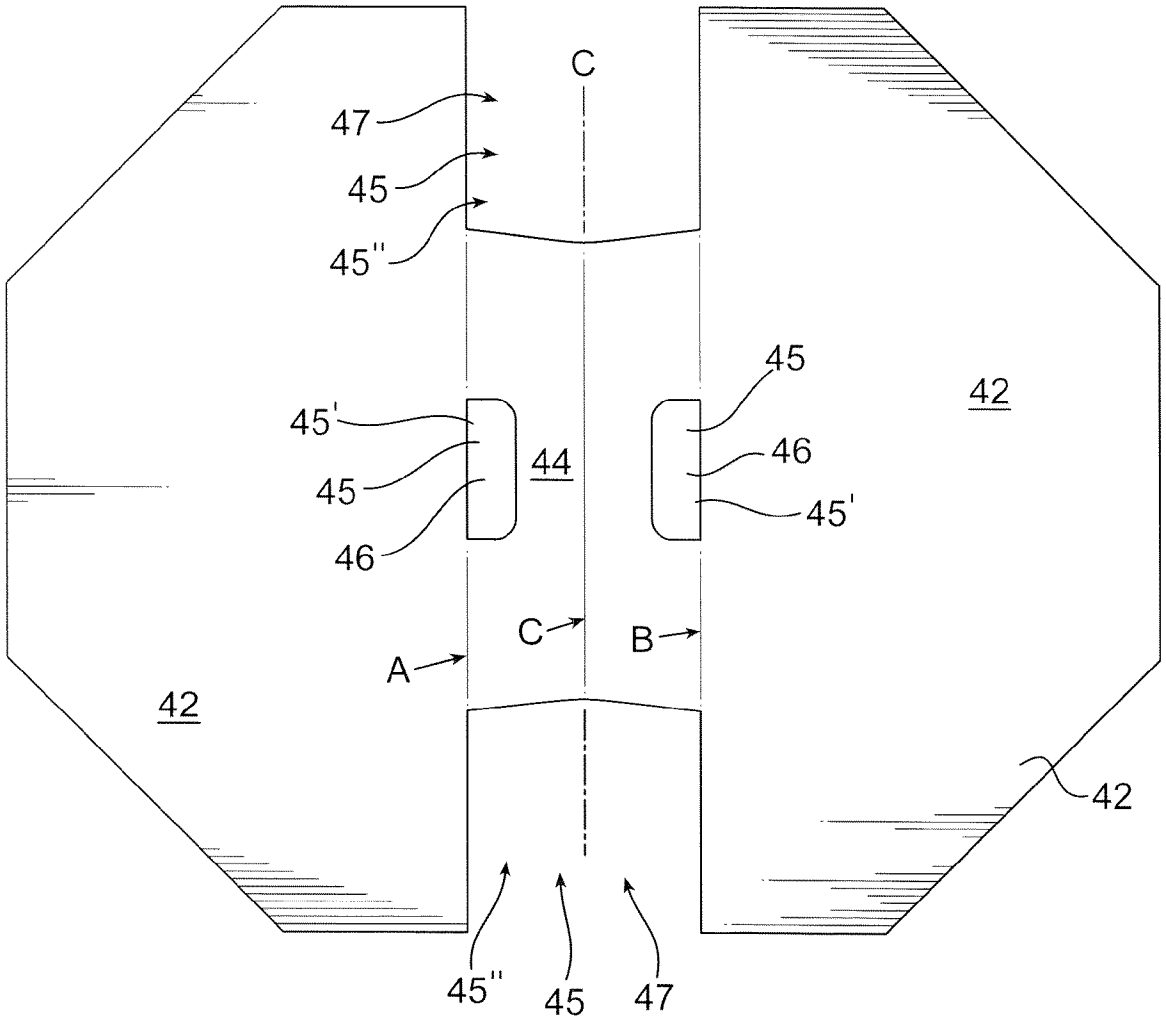
FIG. 3 is a top view of a heading member of the hold down system according to the embodiments of the subject invention.
Figure 4:
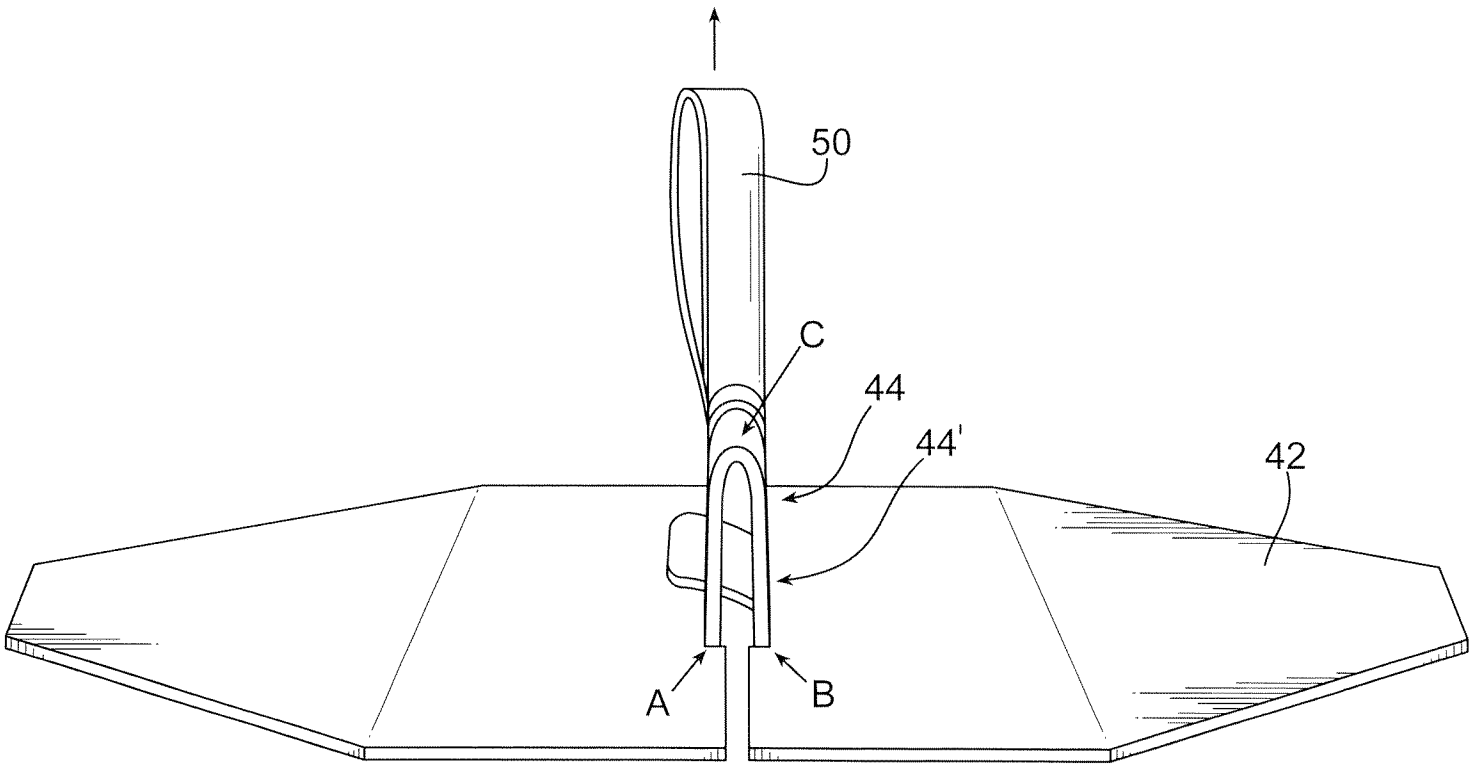
FIG. 4 is a perspective view of a heading member of the hold down system according to the embodiments of the subject invention.
Figure 5:
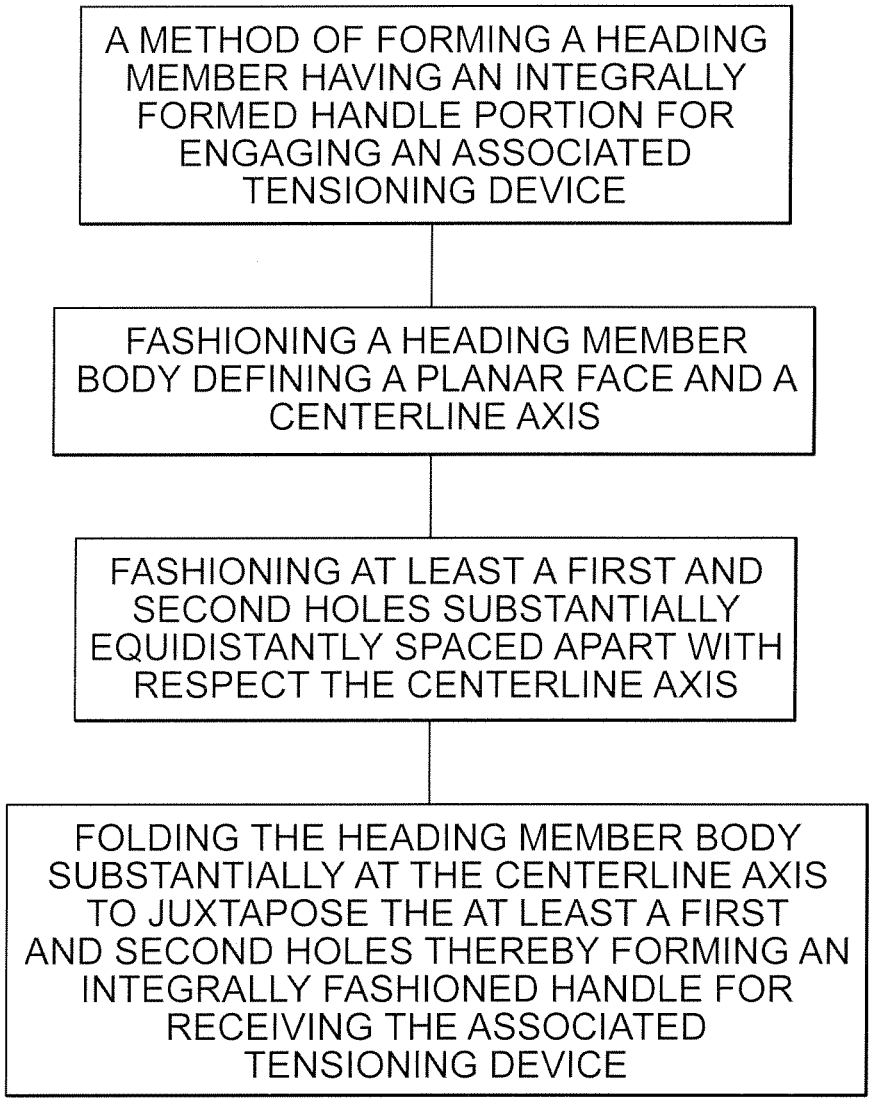
FIG. 5 is a block diagram showing a method of constructing a heading member according to the embodiments of the subject invention.

With reference now to FIGS. 3 and 4, the heading member 42 may be constructed from a material similar to the material comprising the receptacle 10. In one embodiment, the heading member 42 is constructed from fibrous material, like that incorporating wood pulp. Examples include cardboard or paperboard, as well as fiberboard. However, other types of material may be utilized including but not limited to polymeric or polymer based materials. It is noted that the similarities in material of the receptacle 10 and heading member 42 make it easy and convenient to recycle the entire package without disassembly.

With reference again to FIGS. 1 and 2, the heading member 42 may be used to secure a tensioning device 50 extended between another distally positioned heading member 42 or other means of compressively engaging the coil 25, as will be discussed in a subsequent paragraph. The tensioning device 50 may be capable of supplying force used to compress to the coil 25 of wire 13, 14. Accordingly, the tensioning device 50 may be so constructed to overcome the spring forces of the coiled wire 13, 14 thereby preventing loops of wire 13, 14 from lifting off of the coil 25. In one embodiment, the tensioning device 50 may include an elongate strip of material capable of spanning the height of the coil 25 while applying resistive forces to keep the heading member(s) 42 and other means of compressively engaging the coil 25 together. In one exemplary manner, the tensioning device 50 may be elastically deformable, i.e. capable of being stretched to some degree without being permanently deformed. In another example, the tensioning device 50 may be comprised of ropes, straps or other articles not characterized as elastically deformable but readily capable of transmitting forces suitable for compressively engaging the coil 25. Still, any type of tensioning device 50 may be used without departing from the intended scope of the coverage of the embodiments of the subject invention.

With reference now to FIGS. 2 and 3, the heading member 42 may be contiguously formed as a singular article having an integrally formed handle portion 44 for connecting with the tensioning device 50. The handle portion 44 may be defined as that section of the heading member body disposed between slots 45 or openings 45 fashioned therein. In an illustrative manner, the slots 45 may be cutouts formed in the planar face of the heading member 42 that extend through the thickness of the heading member 42. In one embodiment, two sets of slots 45 may be cut into the heading member 42 to form the handle portion 44. For example, one set of slots may be formed from cut holes 45' spaced apart within the heading member body, while another set of slots may be formed by cutting notches 45" in the sides or edges of the heading member body. The holes 45' and/or notches 45" may be equidistantly spaced apart with respect to a centerline axis C, although any spacing pattern may be selected as is useful for forming a handle portion 44. Still, any manner of forming a handle portion integral with the heading member 42 may be chosen without departing from the intended scope of coverage of the embodiments of the subject invention. It will be appreciated that the tensioning device 50 may be secured to the heading member 42 by wrapping around or through the handle portion 44. In an exemplary manner, the tensioning device 50 may be inserted through the holes 45' or received by the notches 45" for fixedly securing the tensioning device 50 to the heading member 42. A separate hook, latch, or other type of fastener is therefore not needed to attach the tensioning device 50 to the integrally formed handle portion 44 of the heading member 42. Still, any manner of wrapping, looping, or connecting the tensioning device 50 to the heading member 42 may be selected that does not include the use of a separate connecting member. Other configurations of cutouts, slots, and ways of attaching the tensioning device 50 will become apparent to those skilled in the art. All such variations are to be construed as falling within the scope of coverage of the appended claims.

It is expressly noted here that the method of forming the heading member 42 has been described in the context of removing material from the body of the heading member 42. However, the heading member 42 with its configuration of holes and/or notches may be fashioned by adding material to form the shape as described herein. In other words, the heading member 42 may be fashioned by molding material, for example, in a tool around inserts thereby forming slots 45 devoid of material, although any method of fashioning the slots 45 may be utilized.

With reference now to FIGS. 3 and 4, in one particular embodiment the heading member 42 may incorporate a series of holes and/or notches fashioned in the heading member 42, as described above. Subsequently, the heading member 42 may be folded upon itself to form a handle portion 44' extending outward from the body of the heading member 42. It is noted that the handle portion 44' is integrally fashioned with heading member 42. Stated another way, the handle portion 44' that receives the tensioning device 50 is not attached with fasteners nor interlocked with the heading member 42, but is contiguously formed therewith. In this configuration, the handle portion 44' includes a single slot or aperture comprised of multiple holes 45' juxtaposed by folding the heading member 42 substantially about a centerline axis C. It follows that the tensioning device 50 may be attached to the handle portion 44' through the opening. It will be readily seen that additional folds are imposed on the heading member 42 at lines A and B, which result in the handle configuration of FIG. 3.

Referencing FIG. 2 once again, the hold down system 40 may include additional components that cover or cap the distal face of the coil 25, which may be upper face 27 of coil 25. In one embodiment, hold down system 40 includes a cover member 53. The cover member 53 may be disk shaped having a generally circular or oval shape, although its circumference may have a polygonal or other shape. The cover member 53 may also be generally rigid or at least semi-rigid for restraining layers of wire 13, 14 making up the coil face. The cover member 53 may be fashioned from semi-circular halves. Alternatively, the cover member 53 may be a contiguously formed article. In any case, the cover member 53 may be juxtaposed to the coil 25, and in particular, the upper face 27, and secured thereto via the compressive forces of tensioning device 50 to prevent the coil 25 from unraveling. In this manner, cover member 53 may include an aperture 54 through which the tensioning device 50 may be fed or routed. In an exemplary manner, the tensioning device 50 may be attached to a bar 57, rod, or other rigid member that sits on top of the cover member 53. Of course, another heading member, similar to the heading member 42 positioned at the bottom face 28 of the coil 25, may be used as the cover member 53 and the tensioning device 50 secured thereto in a similar manner. It will be appreciated that an elastically deformable tensioning device 50 may be stretched to extend through cover member 53, attached thereto in an elongated state and released to provide the compression required to overcome the residual spring forces with the coil 25. Alternatively, non-elastic tensioning devices 50 may be manually tightened and secured in place by any means suitable for use with the embodiments of the subject invention.

A core 22 may be included that extends through the hollow portion of the coil 25. The core 22 along with the inner surface of the receptacle walls 15 may define the space in which the wire 13, 14 is positioned. The core 22 may be secured to the heading member 42. However, detached cores 22 are contemplated that simply lay against the surface of the heading member 42. In one embodiment, the core 22 itself may also be generally hollow. Accordingly, the tensioning device 50 may be channeled through the hollow core 22 and secured to the cover member 53 in a manner consistent with that described herein.

With reference now to all of the Figures, operation of the embodiments of the subject invention will now be discussed. A heading member 42 may be connected with a tensioning device 50 and placed into a receptacle 10. Optionally, a core 22 may be inserted and substantially centered with respect to the heading member 42 wherein the tensioning device 50 may be channeled through the center of the core 22. Wire 13, or welding wire 14, may then be fed into the receptacle 10 and layered in loops around the interior of the receptacle 10 walls forming a stack having a height H. When completed, the stack of wire 13, 14 may be capped by a cover member 53 and the tensioning device 50 connected to provide a compressive force that will hold the coiled wire 13, 14 together during transportation and/or storage of the wire 13, 14. It is expressly noted that the hold down system 40 may be used with wire 13, 14 that is un-twisted or pre-twisted to any degree. The receptacle 10 may be then closed by lid 20 and prepared for shipment or storage as desired.

The invention has been described herein with reference to the disclosed embodiments. Obviously, modifications and alterations will occur to others upon a reading and understanding of this specification. It is intended to include all such modifications and alterations insofar as they come within the scope of the appended claims or the equivalence thereof.

The invention claimed is:

1. A receptacle for storing associated wire in a coil, the coil defining a coil face, comprising:

one or more receptacle walls forming an enclosed region for containing the coil of associated wire;

means for compressively engaging the coil to inhibit unraveling of the associated wire; and, a heading member substantially spanning an area defined by the coil face, wherein the heading member includes a handle portion integrally formed with the heading member for receiving said means for compressively engaging the coil, and wherein the heading member and the handle portion are formed of a fibrous material including wood pulp or a polymer based material as a singular unitary article.

2. The receptacle as defined in claim 1, wherein the handle portion comprises slots that receive said means for compressively engaging the coil.

3. The receptacle as defined in claim 2, wherein said means for compressively engaging the coil comprise a tensioning device capable of withstanding tension forces for compressively engaging the coil; and, wherein the slots comprise one or more holes fashioned to receive the tensioning device.

4. The receptacle as defined in claim 3, wherein the tensioning device is at least one strip of material capable of transmitting tension forces for compressively engaging the coil.

5. The receptacle as defined in claim 3, wherein the tensioning device comprises an elastic band of material for compressively engaging the coil.

6. The receptacle as defined in claim 3, wherein said means for compressively engaging the coil further comprises:

a cover member adapted to receive the tensioning device.

7. The receptacle as defined in claim 1, wherein the heading member folds to form an integrally fashioned handle extended outward from the surface of the heading member.

8. The receptacle as defined in claim 1, wherein the heading member is comprised of a recyclable material.

9. A hold down device for inhibiting associated coiled wire from unraveling, the hold down device comprising:

a cover member for bounding a first face of an associated coil of wire; and, a tensioning device extendable through a height of the associated coil of wire, the tensioning device is adapted to supply force used to inhibit the associated coil of wire from unraveling; and, a heading member bounding a second coil face, wherein the heading member includes an integrally formed handle for connecting to the tensioning device, and wherein the heading member and the handle portion are formed of a fibrous material including wood pulp or a polymer based material as a singular unitary article.

10. The hold down device as defined in claim 9, wherein the heading member defines a body and wherein one or more slots are fashioned in the body of the heading member to comprise the handle for receiving the tensioning device.

11. The hold down device as defined in claim 9, wherein the heading member comprises a body having one or more slots for connecting to the tensioning device, and wherein at least part of the heading member folds to form the handle that extends outward with respect to the body of the heading member.

12. The hold down device as defined in claim 11, wherein the body of the heading member is generally planar and is comprised of a recyclable material.

13. The hold down device as defined in claim 11, wherein the body of the heading member and the handle are comprised of substantially the same material.

14. A recyclable receptacle for storing associated coiled wire, comprising:

one or more receptacle walls defining an enclosed space for receiving the associated coiled wire;

a generally planar heading member spanning a face of the associated coiled wire and having a handle, wherein the generally planar heading member and the handle are formed of a fibrous material including wood pulp or a polymer based material as a singular unitary article; and, means for compressively engaging the associated coiled wire which when connected to the handle substantially prevents the associated coiled wire from unraveling; and, wherein the generally planar heading member and the handle is comprised of substantially the same material of the one or more receptacle walls.

15. The recyclable receptacle as defined in claim 14, wherein the handle is integrally formed with generally planar heading member; and, wherein at least a portion of the heading member folds to form the handle.

* * * * *